US005492486A

United States Patent [19]

Tanigawa

[11] Patent Number: 5,492,486

[45] Date of Patent: Feb. 20, 1996

[54] CONNECTOR FOR FLAT CABLES

[75] Inventor: Junichi Tanigawa, Kawasaki, Japan

[73] Assignee: The Whitaker Corporation, Wilmington, Del.

[21] Appl. No.: 492,331

[22] Filed: Jun. 19, 1995

Related U.S. Application Data

[63] Continuation of Ser. No. 182,324, Jan. 14, 1994, abandoned.

[30] Foreign Application Priority Data

Jan. 27, 1993 [JP] Japan ..... 5-005334 U
Oct. 15, 1993 [JP] Japan ..... 5-060362 U

[51] Int. Cl.[6] ..... H01R 9/07
[52] U.S. Cl. ..... 439/495
[58] Field of Search ..... 439/495, 441, 439/842

[56] References Cited

U.S. PATENT DOCUMENTS 2,617,844 11/1952 Sanda ..... 439/441
5,110,305 5/1992 Edgley et al. ..... 439/495 X

FOREIGN PATENT DOCUMENTS 4023072 1/1992 Germany ..... 439/842
4023073 1/1992 Germany ..... 439/842
64-13682 3/1989 Japan .

*Primary Examiner*—Larry I. Schwartz
*Assistant Examiner*—Daniel Wittels
*Attorney, Agent, or Firm*—Adrian J. LaRue; Timothy J. Aberle

[57] ABSTRACT

An electrical connector (1,1') having multiple contacts (40') are arranged in the insulating housing (10) at a predetermined pitch and have a J-shaped connecting section (44). When an external force (F), which tends to pull a flat cable (4) in a direction away from connector (1) is applied to the flat cable (4), connecting sections (44) of all contacts (40) are bent and their back surfaces (56) are pressed against the inner wall (30) of the insulating housing (10). This pressure generates resistance from the inner wall (30) resulting in a strong frictional force between connecting sections (44) and flat cable (4), thus reliably securing cable (4) in the connector housing.

15 Claims, 3 Drawing Sheets

CONNECTOR FOR FLAT CABLES

This application is a continuation of application Ser. No. 08/182,324 filed Jan. 14, 1994, now abandoned.

This invention relates to electrical connectors for flat cables, especially for connectors with multiple contacts intended for the attachment to the ends of flexible flat cables (FFC or FPC).

BACKGROUND OF THE INVENTION

FFC-type cables are highly flexible, have multiple conductors, and are extraordinarily convenient in work and versatile in applications. Therefore, FFC-type cables and related connectors are widely used in such home electronic devices as compact-disk players and video cameras, and in such office equipment as copiers and facsimile machines.

There is a number of connectors offered for use with the FFC cables, for example, connectors described in the disclosure publication of Japanese Utility Model No. 64 (1989)-13682. In such conventional connectors for cables, connections are generally made by inserting the end of the FFC cable and the extension of a slider between one beam-shaped contact and the inner wall of the insulating housing.

However, because of the necessity to use sliders, such connectors for the cables become rather large and have many parts, which is inconsistent with the latest requirements toward the reduction of the dimensions and the cost of electronic equipment. In addition, since the insertion of the FFC cable using the slider can be done with little or without any insertion force, its retention force in the connector depends entirely on the elasticity of the beam-shaped contact, and, as a rule, the retention force is rather low.

Therefore, the purpose of this invention is to offer a connector for flat cables free of the above mentioned problems associated with the conventional connectors for FFC cables, which is easy to manufacture, provides for an easy connection, has a small number of parts and small dimensions, and which is characterized by a high cable-retention force.

SUMMARY OF THE INVENTION

Connectors for flat cables according to this invention have a number of contacts arranged along a narrow opening made in the insulating housing, and are characterized by the fact that the contacts have J-shaped connecting sections fabricated by upsetting, and by the fact that when the above mentioned flat cable is inserted in the opening of the insulating housing, it becomes engaged with the free ends of the J-shaped connecting sections, and when a pulling-out force is applied to the cable, the back side of the J-shaped connecting sections becomes engaged with the inner wall of the insulating housing.

When a flat cable is inserted into the opening made for this purpose in the insulating housing to the point where it comes into contact with the contacts of the connector, and when a force is applied in the direction of pulling the cable out, the back sides of the J-shaped sections of the contacts are deflected and forced against the inner wall of the housing. The force of friction between the flat cable and the J-shaped sections of the contacts increases with the increase in the pulling force, thus providing a reliable retention of the cable in the connector.

Below, we give explanations concerning preferred embodiments of the connector for flat cables according to this invention with reference to the appended drawings.

BRIEF DESCRIPTION OF THE DRAWINGS

FIG. 1 is a front view, FIG. 2 is a bottom view, and FIG. 3 is a cross-sectional view along the 3—3 line indicated in FIG. 2.

DETAILED DESCRIPTION OF THE INVENTION

Figure 1:
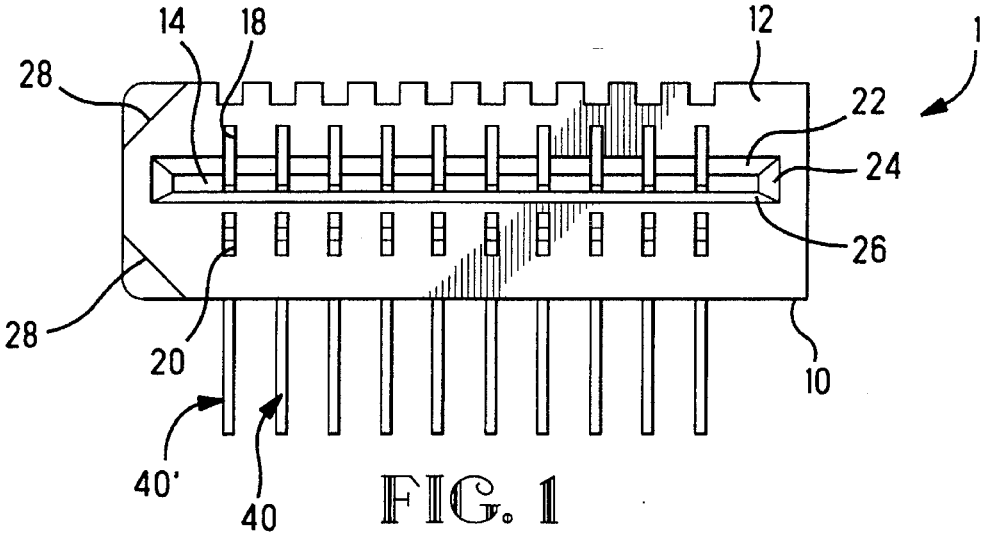
FIGS. 1–3 show an embodiment of a connector for flat cables according to the instant invention, where
Figure 2:
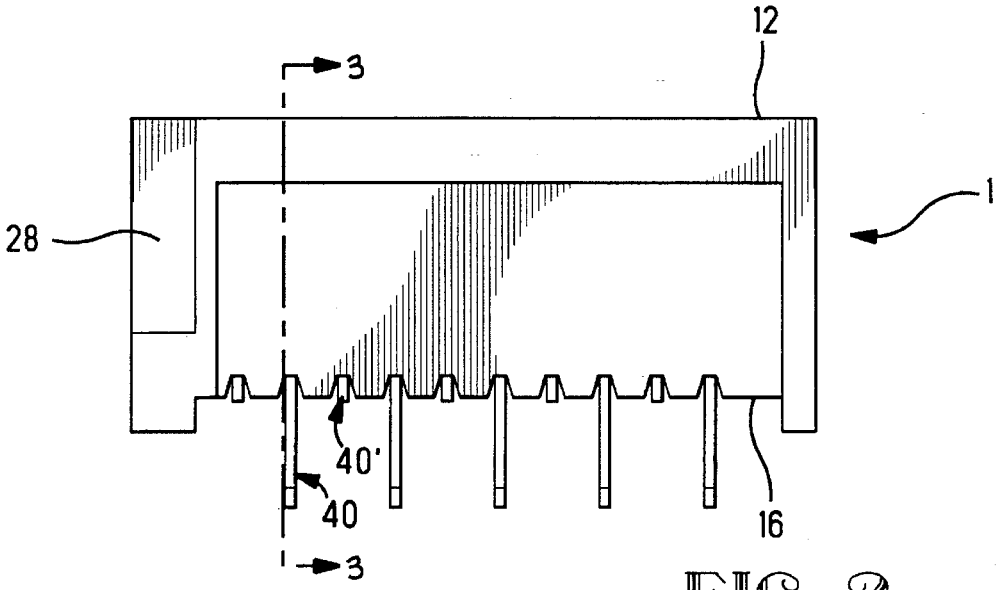

Connector 1 for flat cables (FFC) consists of a rectangular insulating housing 10 and a number of contacts 40 (in this specific case 10 contacts) arrayed along a longer side of the housing 10. Opening 14 for receiving the flat cable is made in surface 12 of the insulating housing 10 in a longitudinal direction. In addition, primary slots 18 and secondary slots 20 are made through surface 12 and opposite surface 16 in such a manner as to intersect the insertion opening 14 at a pitch of, for example, 1.25 mm. The insertion opening 14 has tapered surfaces 22, 24, and 26 at the surface 12 in order to facilitate the insertion of the FFC. At one end of the insulating housing 10, two corners are tapered to make surfaces 28, 28 for the purposes of polarity discrimination.

Figure 3:
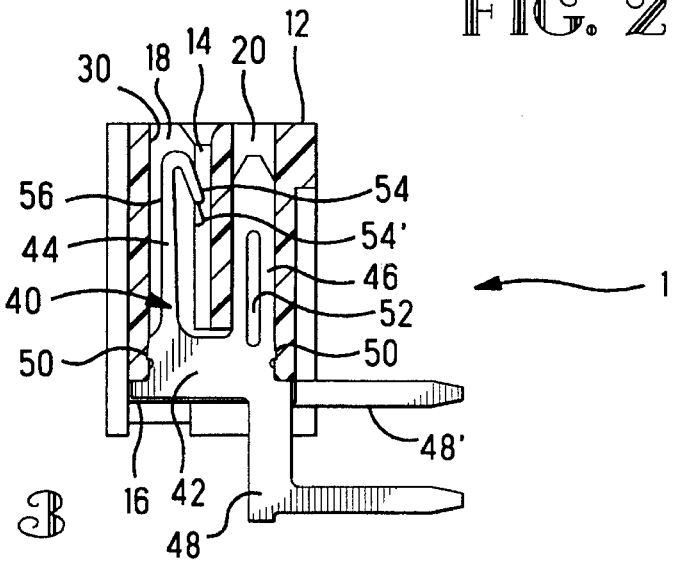

As shown in FIG. 3, contact 40 comprises a J-shaped connecting section 44, and a stabilizer 46 extending upward from base section 42, and a soldering tail 48 (48') extending from base section 42 downward or to the side. Connecting section 44 and stabilizer 46 are inserted respectively in the primary slots 18 and secondary slots 20 of the insulating housing 10, and base section 42 straddles primary and secondary slots 18, 20. A pair of protrusions 50, 50 made in the base section 42 are pressed in the inner wall of the insulating housing 10. Stabilizer 46 has a bead 52 formed in it for the purpose of securing the position of the contact 40 and the direction of the connecting section 44 by being pressed against the inner wall of the secondary slot 20. The free end 54 of the J-shaped connecting section 44 protrudes inside the insertion opening 14 and forms a contact for connection to the FFC. Free ends 54, 54' of adjacent contacts 40, 40' are positioned at different levels in the direction of the FFC insertion (for staggered arrangement). This arrangement makes it possible to reduce the force required for the insertion of FFC. Soldering tails 48, 48' of adjacent contacts 40, 40' are also staggered, in order to simplify their attachment to the base board (not shown in the Figure).

Figure 4:
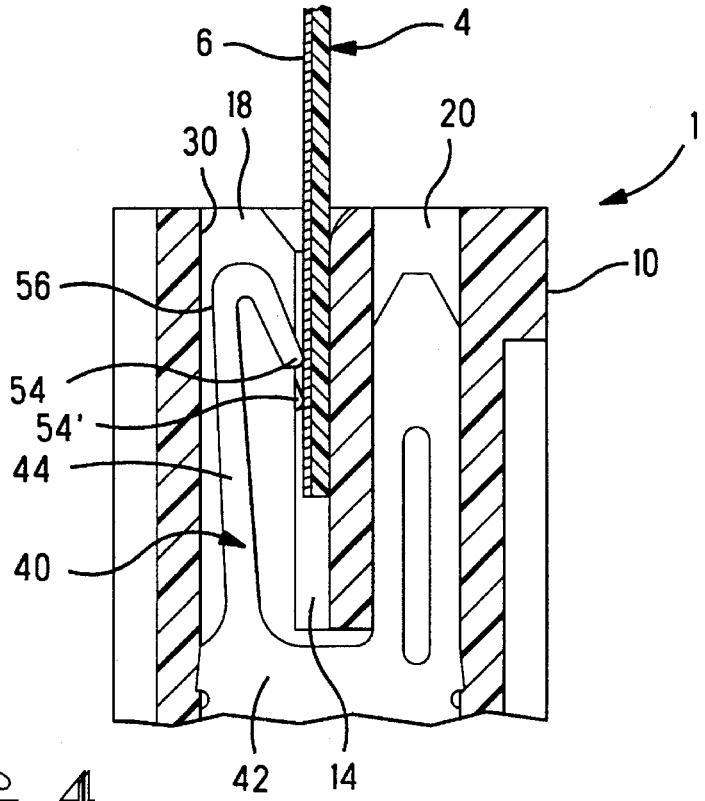
FIG. 4 is a cross-sectional view of a connector for flat cables same as the one shown in FIG. 3 showing the the status when a flat cable is in process of insertion in the connector shown in FIG. 1.
Figure 5:
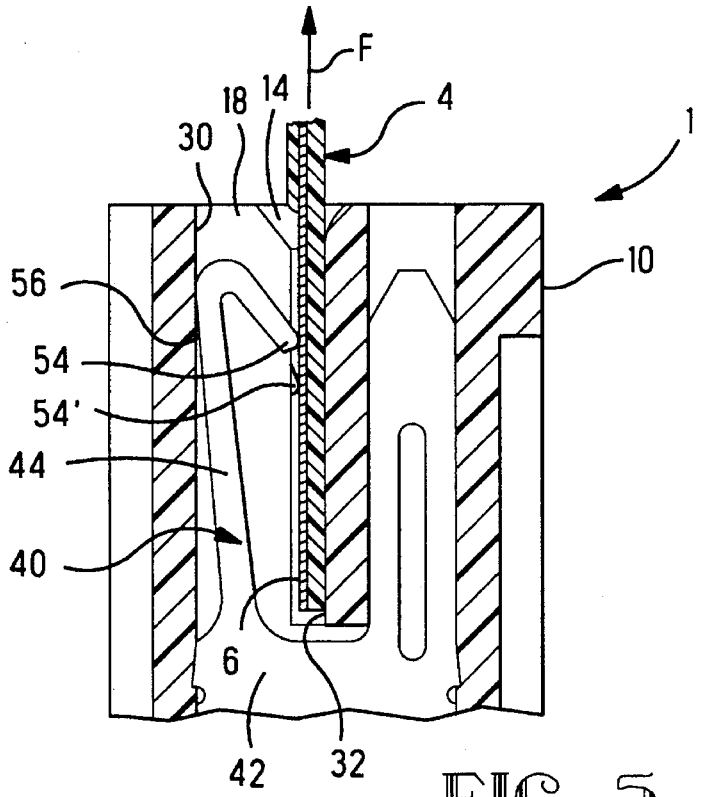
FIG. 5 is the same cross-sectional view of the connector for flat cables as the one shown in FIG. 4, but which shows the status of the connector when a flat cable is pulled out from the connector shown in FIGS. 1–3.

FIG. 4 represents a cross section of the connector shown in FIG. 1 in a state when the FFC is inserted in it. FIG. 5 represents a cross section of the connector shown in FIG. 1 in a state after the FFC has been inserted in it and a pulling out force is applied to the cable.

In FIG. 4, FFC 4 is inserted in the insertion opening 14 to overcome elastic resistance of the J-shaped connecting sections 44 thus deflecting them towards the inner wall 30. It is important to indicate that during the insertion of the FFC, back surfaces 56 of connecting sections 44 do not touch the inner walls 30 of the primary slots 18. Due to the fact that back surfaces 56 do not touch inner walls 30 and that free ends 54, 54' of the connecting sections are staggered, FFC 4 can be inserted in the insertion opening 14 with a relatively low resistance. Since free ends 54, 54' which come in contact with the conductors 6 of the FFC 4 are slightly rounded, they do not damage conductors 6 of the FFC 4.

FIG. 5 depicts the status when an external force F is applied to the FFC 4 to pull it out of the connector 1. This causes free ends 54 of connecting sections 44 of contacts 40 to turn counterclockwise and to bend towards the inner wall 30 of the primary slots 18 so that back side 56 of the connecting section 44 comes against the inner wall 30. Due to the resistance produced by the contact between this inner wall 30 and the back surface 56, FFC 4 becomes affected by a strong frictional resistance developed between the free end 54 of the connecting 44 and the other wall 32 of the primary slot 18. As a result, the FFC 4 cannot be easily pulled out of the connector 1. Therefore, the retention strength of FCC 4 in connector 1 is greatly improved.

Figure 6:
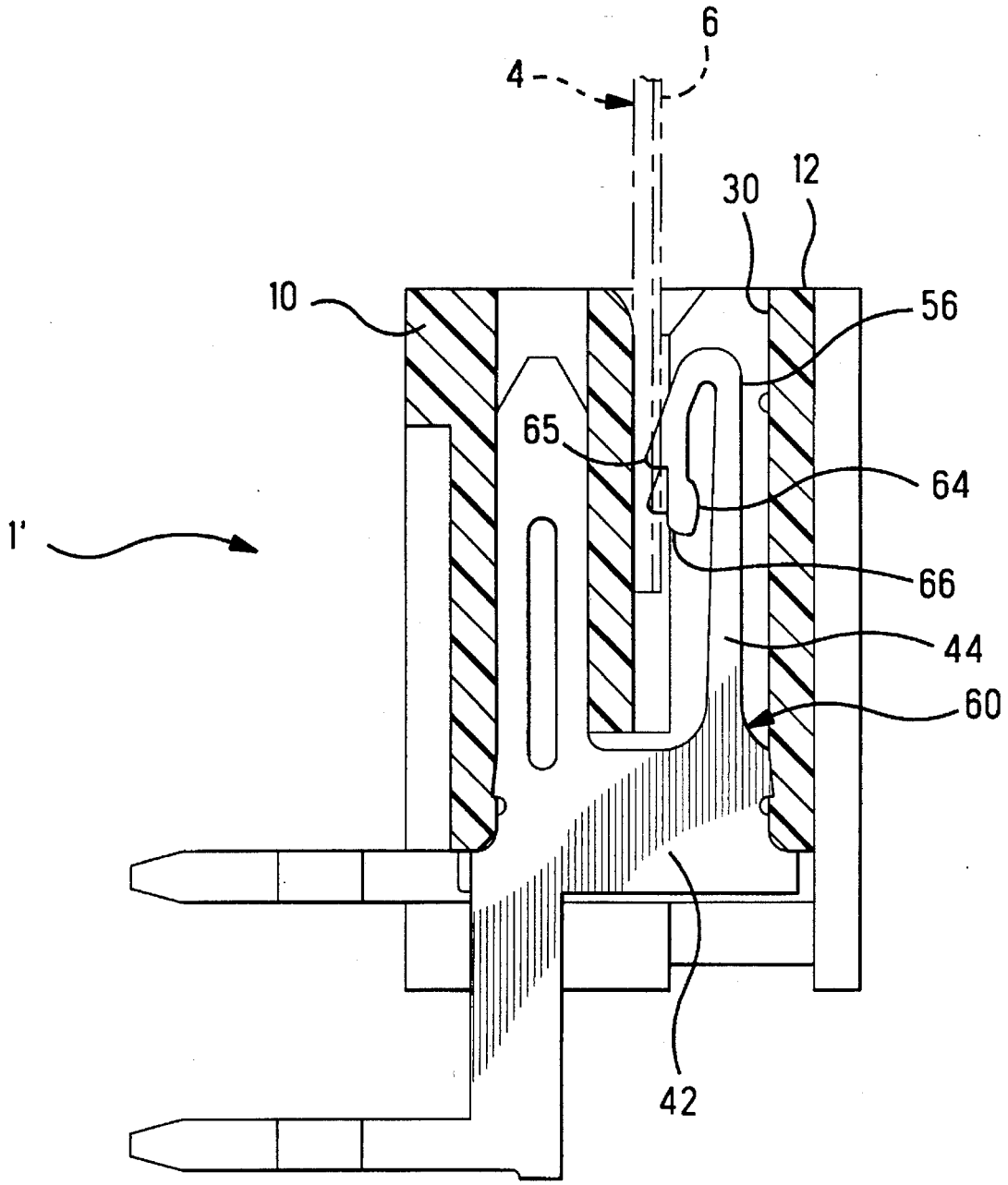
FIG. 6 shows another embodiment of the connector for flat cables according to this invention; shown along the same cross-sectional view as in the FIG. 4.

FIG. 6 represents another embodiment of the connector for flat cables according to this invention. Contacts 60 of connector 1' for flat cables differ from the contacts 40 by their free ends 64. Other parts of the contacts are the same as in the contacts 40. Below, the parts of these contacts that are the same as in the contacts 40 will be designated by the same numbers. The free ends 64 are different from the free ends 54 in that their portion extending downward is longer. The protrusions 65 which are the same as in the free ends 54 are intended to make an electrical contact with the conductors 6 when the FFC 4 is inserted in the connector. The positions of the contact 60 and the free end 64, as shown in FIG. 6, are when the FFC 4 is not inserted in the connector.

The free ends 64 are made elongated in order to increase the retaining force on the FFC 4 even more, and to protect the connecting section 44 of the contact 60. The free ends 54 of the contacts 40 in the previous embodiment provide sufficient retaining force to the FFC 4, however, if the force pulling the FFC 4 out of the connector exceeds a certain limit, the free ends 54 may be deformed in the direction of the pulling force. As a result, the free ends 54 will be bent upward and away from the surface 12 of the insulating housing 10. In the case of the contact 60, the free ends 64 are not deformed as in the previous case, thus providing a high retention strength over a long period of time. That is, when the protrusions 65 are pulled upward, as shown in FIG. 6, while the back surface 56 of the contact 60 is pressed against the inner wall 30, the contacting surface 66 of the free end 64 starts to rotate clockwise and comes in contact with the FFC 4. As a result, the upward movement of the protrusions 65 is blocked, and the FFC 4 becomes securely retained in the insulating housing 10.

Above, detailed explanations concerning a connector for flat cables according to this invention have been provided. This invention is not limited to the described embodiments only, and may be changed or modified depending on specific requirements or circumstances. For example, the soldering tails can extend downwards or in the direction opposite to the one shown in the embodiments. Soldering tails can also be of the SMT (surface mounting technology) type rather than the DIP type shown in the embodiments. It is also possible to provide posts in the insulating housing to index its position relative to the base board. Further, it is possible to incorporate in the insulating housing the key device described in the Japanese Utility Model Application 4 (1992)-23928.

The main advantage of the connectors for flat cables according to this invention resides in the fact that they provide a high retention of the cable in the connector without any additional structural elements. Since there is no need to use sliders for securing the flat cable in the connector, they have fewer parts, are cheaper in production, and are easier in installation.

I claim:

1. An electrical connector for electrical cables, comprising:

a dielectric housing with an opening for receiving an electrical cable and slots formed therein for receiving electrical contacts;

an electrical contact having portions thereof received in a pair of said slots, said slots being separated by a portion of said housing;

said electrical contact portions comprising a resiliently deflectable connecting section and a stabilizing section which each project away from a base section of said electrical contact;

whereby upon insertion of said electrical cable into said housing said resilient connecting section engages and deflects in a direction away from said electrical cable, and a force which tends to separate said cable from said housing causes an end portion of said resilient connecting section to engage the housing and the electrical cable at the same time thereby securing said electrical cable to said electrical contact and said housing, and the portion of said resilient connecting section between said end portion and said base section of said electrical contact is a generally straight contact section, the stabilizing section has a proximal end which joins the stabilizing section to the base of the contact, and a distal end opposite said proximal end, the stabilizing section being rigid between said ends.

2. The electrical connector of claim 1, wherein the resilient connecting section includes at least two deflectable portions separated by an acute angle bend for deflection when said cable is in the inserted position.

3. The electrical contact of claim 1, wherein said resilient connecting section end portion comprises a free end portion which is directed towards said base section for contacting said cable.

4. The electrical contact of claim 1, wherein the resilient connecting section includes a J-shaped portion which engages an outer wall of one of said slots when said separating force pulls on said cable, said cable is frictionally retained by engagement with a dielectric portion of an inner wall of said one slot and said J-shaped portion.

5. An electrical connector for electrical cables, comprising:

a dielectric housing with an opening for receiving an electrical cable, and slots formed therein for receiving electrical contacts;

an electrical contact having portions thereof disposed in a pair of said slots, said slots being separated by a portion of said housing defining a partition, said partition defining first and second inner wall surfaces of said slots;

said electrical contact portions comprising a resiliently deflectable connecting section disposed in a first slot, a stabilizing section disposed in a second slot, and a base section from which said connecting and stabilizing sections extend;

whereby when said electrical cable is in an inserted position relative to said housing, a force which tends to separate said cable from said housing causes an end portion of said connecting section to engage the housing and the electrical cable at the same time thereby securing said electrical cable to said electrical contact and said housing, said stabilizing section comprises a longitudinal axis said partition walls being generally parallel thereto across generally their entire length.

6. The electrical connector of claim 5, wherein said connecting section consists of a generally straight contact section.

7. The electrical connector of claim 5, wherein said cable comprises a flat cable and said housing opening comprises a transverse slot which transects a plurality of said slots for receiving said flat cable.

8. The electrical connector of claim 5, wherein when said cable is not in an inserted position relative to said housing, said connecting section extends generally directly up towards said cable opening without any preformed bends formed at a transition section where said connecting section is joined to said base section.

9. The electrical connector of claim 5, wherein when said cable is not in an inserted position relative to said housing, said connecting section extends generally directly up towards said cable opening without any preformed bends formed between a transition section, where said connecting section is joined to said base section, and said end portion.

10. The electrical connector of claim 5, wherein said stabilizing section includes a bead.

11. An electrical connector for connection to a flexible flat cable, comprising:

a dielectric housing having an opening to receive an end of the flexible flat cable and a plurality of slots perpendicular to the opening, each of the plurality of slots being separated by an isolation wall extending inwardly from one end of the housing at which the flexible flat cable is to be inserted thereby forming primary slots and secondary slots;

a plurality of flat electrical contacts inserted in the slots in said housing from another end thereof, each of the electrical contacts has a base section positioned in the slots at the other end of said housing, a stabilizing section extending from the base section and disposed in the secondary slot, a J-shaped resilient connecting section extending from the base section and extending along the primary slot, said connecting section having a free end bent at an acute angle toward said isolation wall and the base section, and a soldering tail extending outwardly from said housing.

12. The electrical connector of claim 11, wherein said stabilizing section has a bead therein.

13. An electrical connector as claimed in claim 11, wherein the connecting sections of the electrical contacts resiliently deform to abut against a wall of the primary slots at distal ends from the base sections when an extraction force is applied to the flexible flat cable.

14. An electrical connector as claimed in claim 11, the connecting sections have staggered free ends.

15. An electrical connector as claimed in claim 11, wherein the free ends of the connecting sections have protrusions.

* * * * *